US005923925A

United States Patent [19]

Nakamura et al.

[11] Patent Number: 5,923,925

[45] Date of Patent: Jul. 13, 1999

[54] ELECTROPHOTOGRAPHIC APPARATUS

[75] Inventors: Kazushige Nakamura, Yokohama; Akio Maruyama, Tokyo; Noboru Kashimura; Shoji Amamiya, both of Kawasaki, all of Japan

[73] Assignee: Canon Kabushiki Kaisha, Tokyo, Japan

[21] Appl. No.: 08/841,637

[22] Filed: Apr. 30, 1997

Related U.S. Application Data

[63] Continuation of application No. 08/624,755, Mar. 27, 1996, abandoned, which is a continuation of application No. 08/492,934, Jun. 21, 1995, abandoned.

[30] Foreign Application Priority Data

Jun. 22, 1994 [JP] Japan ..... 6-140206
Jun. 22, 1994 [JP] Japan ..... 6-140208

[51] Int. Cl.[6] ..... G03G 15/00

[52] U.S. Cl. ..... 399/116; 430/67; 399/159

[58] Field of Search ..... 399/116, 159; 430/66, 67

[56] References Cited

U.S. PATENT DOCUMENTS

| | | | |
|---|---|---|---|
| 4,851,960 | 7/1989 | Nakamura et al. | 361/225 |
| 4,877,701 | 10/1989 | Hiro et al. | 430/59 |
| 5,008,172 | 4/1991 | Rokutanzono et al. | 430/67 |
| 5,245,386 | 9/1993 | Asano et al. | 355/219 |
| 5,357,320 | 10/1994 | Kashimura et al. | 355/211 |
| 5,374,494 | 12/1994 | Kashimura et al. | 430/67 |
| 5,383,011 | 1/1995 | Numagami et al. | 355/298 |
| 5,385,797 | 1/1995 | Nagahara et al. | 355/211 X |
| 5,391,446 | 2/1995 | Ohtani et al. | 430/58 |
| 5,391,449 | 2/1995 | Maruyama et al. | 430/66 |
| 5,393,628 | 2/1995 | Ikezue et al. | 430/59 |
| 5,422,210 | 6/1995 | Maruyama et al. | 430/59 |
| 5,455,135 | 10/1995 | Maruyama et al. | 430/58 |

FOREIGN PATENT DOCUMENTS

| | | | |
|---|---|---|---|
| 0524506 | 7/1992 | European Pat. Off. . | |
| 0589776 | 9/1993 | European Pat. Off. . | |
| 0602651 | 12/1993 | European Pat. Off. . | |
| 0606074 | 1/1994 | European Pat. Off. . | |
| 56-104351 | 8/1981 | Japan . | |
| 57-178267 | 11/1982 | Japan . | |
| 58-40566 | 3/1983 | Japan . | |
| 58-139156 | 9/1983 | Japan . | |
| 58-150975 | 9/1983 | Japan . | |
| 61-57958 | 3/1986 | Japan . | |
| 63-149668 | 6/1988 | Japan . | |
| 63-189880 | 8/1988 | Japan | 355/211 |

OTHER PUBLICATIONS

Derwent Publications Ltd., AN 90–027551.
Derwent Publications Ltd., AN 81–84571d.

*Primary Examiner*—Richard Moses
*Attorney, Agent, or Firm*—Fitzpatrick, Cella, Harper & Scinto

[57] ABSTRACT

An electrophotographic apparatus has an electrophotographic photosensitive member having a photosensitive layer on an electroconductive support, a charging means provided in contact with the photosensitive member, and image exposure means, a development means, and an image transfer means. The electrophotographic photosensitive member has a surface layer containing electroconductive particles having particle surface treated with a fluorine-containing compound, and a binder resin.

10 Claims, 1 Drawing Sheet

ELECTROPHOTOGRAPHIC APPARATUS

This application is a continuation of application Ser. No. 08/624,755, filed Mar. 27, 1996, now abandoned, which, in turn, is a continuation of application Ser. No. 08/492,934, filed Jun. 21, 1995, now abandoned.

BACKGROUND OF THE INVENTION

1. Field of the Invention

The present invention relates to an electrophotographic apparatus, more specifically to an electrophotographic apparatus having a charging means provided in contact with an electrophotographic photosensitive member.

2. Related Background Art

In electrophotography, an image is obtained by use of an electrophotographic photosensitive member (hereinafter simply referred to as a "photosensitive member") containing a photosensitive material such as selenium, cadmium sulfide, zinc oxide, amorphous silicon, and organic photoconductive substances through basic processes of electric charging, light image exposure, latent image development, image transfer, image fixation, cleaning of the electrophotographic member, and so forth. The electric charging process is conventionally conducted by corona discharge caused by application of high DC voltage (5 to 8 KV) to a metal wire. This method, however, has disadvantages that the corona discharge products such as ozone and $NO_x$ deteriorate the surface of the photosensitive member to cause fogging and low quality of images; soiling of the wire impairs image quality to cause white blank or black stripes in the formed image; and so forth. In particular, a photosensitive member having a photosensitive layer composed mainly of an organic photoconductive material is less stable chemically, and is liable to deteriorate by chemical reaction (mainly by oxidation) on exposure to the corona products in comparison with the photosensitive members such as selenium photosensitive member and amorphous silicon photosensitive member. Therefore, this type of photosensitive member tends to deteriorate to cause fogging of images and decrease of copied image density during repeated use under corona charging, resulting in short printing life of the photosensitive member.

The corona charging is less efficient as the charging means because the electric current directed to the photosensitive member is only 5 to 30% of the entire current, and most of the current flows to the shield plate.

In order to offset such disadvantages, methods are investigated in which the surface of the photosensitive member is charged by application of voltage to the surface by use of a charging member provided in contact with the surface of the photosensitive member without employing a corona discharger, as disclosed in JP-A-57-178267, JP-A-56-104351, JP-A-58-40566, JP-A-58-139156, JP-A-58-150975, etc. ("JP-A" herein means Japanese Patent Laid-Open Application).

More specifically, the surface of the photosensitive member is charged to a prescribed potential by bringing a charging member like an electroconductive elastic roller into contact with the surface of the photosensitive member with application of DC voltage of about 1 to 2 KV to the charging member.

In spite of many proposals on such types of charging methods, few of them are commercialized because of non-uniformity of the charging, liability of dielectric breakdown of the photosensitive member, and other reasons. The non-uniformity of the charging signifies spot-like irregularity in the charging of the surface of the photosensitive member, which causes image defects such as white dots in normal development (white dots in a solid black image) or fogging in reversal development.

In order to improve the uniformity of the charging without the above problems, a method is proposed in which pulse voltage formed by superposition of AC voltage (VAC) to the DC voltage (VDC) is applied to the charging member to charge uniformly the surface of the photosensitive member (JP-A-63-149668).

In this method, in order to prevent image defects like fogging, white dots in normal development, or black dots in reversal development, the potential difference ($V_{p-p}$) between the peaks of the AC voltage needs to be twice or more the DC voltage.

This method involves problems as follows. As the superposing AC voltage is raised to prevent the image defects, the maximum application voltage in the pulse voltage rises also, which tends to cause dielectric breakdown at slightly defective site in the photosensitive member. In particular, this tendency is remarkable in a photosensitive member employing an organic photoconductive material which has a relatively low dielectric strength. The dielectric breakdown of the photosensitive member will cause white blank (white stripes) in normal development and black stripes in reversal development in the length direction of the contact portion. A pinhole in the photosensitive layer give rise to leakage of the current through the pinhole portion to lower the applied voltage to cause white stripes or black stripes.

In a direct charging method, the application of pulse voltage causes noise generation owing to vibration between the charging member and the photosensitive member corresponding to the frequency of the applied voltage. This noise tends to become larger with the increase of the $V_{p-p}$ and of the frequency of the applied AC. This is also a serious problem.

JP-A-61-57958 discloses a uniform charging method. In this method, a photosensitive member employed has a protection layer having a resistivity controlled by electroconductive particles dispersed therein, the electroconductive fine particles are brought into contact with the photosensitive member, and voltage is applied directly to the electroconductive fine particles to inject electric charge into the protection layer, thereby uniform charging being attained.

In this method, the material constituting the electroconductive particles which are dispersed in the protection layer includes metals such as copper, aluminum, and nickel, and metal oxides such as zinc oxide, tin oxide, antimony oxide, and titanium oxide. The dispersion state of the particles affects greatly the uniformity of the electric charge injection. If the dispersion is poor, the charge injection becomes non-uniform to lower the chargeableness or to cause irregular charging. Therefore, uniform dispersion of the electroconductive particles is especially important in this method.

However, metal particles or metal oxide particles tend to agglomerate in a resin or in a resin solution. The formed dispersion of such particles, after it has been formed, is liable to cause secondary agglomeration or precipitation. Therefore it is extremely difficult to disperse well such electroconductive particles. In particular, fine particles (primary particle diameter of not larger than 0.3 $\mu$m) or ultrafine particles (primary particle diameter of not larger than 0.1 $\mu$m) of such a material, which are desired to be uniformly dispersed for achieving uniform chargeableness, exhibit more pronounced tendency of less dispersibility and less dispersion stability. Thus the fine particles has problems of low chargeableness and charge irregularity caused by less charge injectableness resulting from less dispersibility of the electroconductive particles, which causes deterioration of image such as irregularity and decrease of image density, and fogging of images.

In recent years, with the progress in image quality for sharpness of a latent image and use of finer toner particles, electrophotographic apparatuses are being investigated which are capable of giving more uniform charging.

SUMMARY OF THE INVENTION

The present invention intends to provide an electrophotographic apparatus which is capable of giving stable copy images of higher quality without an image defect such as irregularity of image density, low image density, white dots and fogging caused by irregularity of electric charging and leakage in a photosensitive member.

The electrophotographic apparatus of the present invention comprises an electrophotographic photosensitive member having a photosensitive layer on an electroconductive support, a charging means provided in contact with the photosensitive member, an image exposure means, a development means, and an image transfer means: the electrophotographic photosensitive member having a surface layer containing electroconductive particles having particle surface treated with a fluorine-containing compound, and a binder resin.

DESCRIPTION OF THE PREFERRED EMBODIMENTS

Figure 1:
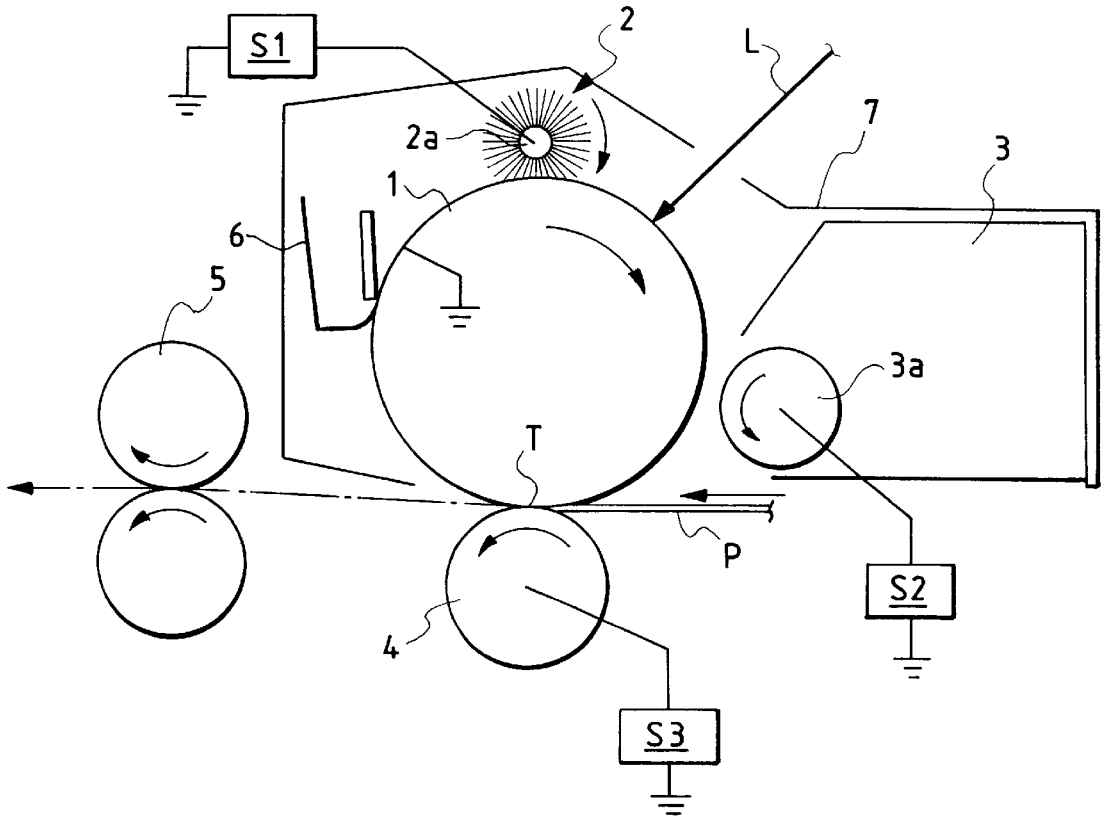
FIG. 1 illustrates schematically a construction of an electrophotographic apparatus of the present invention.

The electrophotographic apparatus of the present invention comprises an electrophotographic photosensitive member having a photosensitive layer on an electroconductive support, a charging means provided in contact with the photosensitive member, an image exposure means, a development means, and image transfer means: the electrophotographic photosensitive member having a surface layer containing electroconductive particles having particle surface treated with a fluorine-containing compound, and a binder resin.

As the results of comprehensive investigation on the aforementioned problems, it was found by the inventors of the present invention that the electrophotographic photosensitive member having a surface layer containing electroconductive particles dispersed therein is improved greatly in dispersibility of the electroconductive particles by surface treatment thereof to enable direct injection of electric charge from a charging member into the surface layer of the photosensitive member, thereby uniformity and stability of the electric charge being remarkably improved.

In the present invention, the electrophotographic photosensitive member employed has a surface layer containing electroconductive particles dispersed therein in order to inject charge directly and uniformly in the electrophotographic photosensitive member from the charging member. The electroconductive particles in the surface layer are treated at the particle surface for efficiency and uniformity of charge injection. If the electroconductive particles have not been surface-treated, the particles will not disperse uniformly, whereby charge injection efficiency is low, and the charging is insufficient and non-uniform, which would cause image defects.

The above effects in the present invention are attained probably by the reasons that (1) the surface treatment of the electroconductive particles improves the uniformity of the particle dispersion, which retards structuring and results in uniform electric charging, and (2) the surface treatment smoothens the surface of the electroconductive particles, which prevents concentration of the electric field caused by the particle shape, thereby giving uniform charging. However, the decisive factors therefor and the relation thereof to the mechanism of charging by use of the charging member provided in contact with the photosensitive member are not clearly known.

The present invention is described below in detail.

The material for the electroconductive particles includes metals, metal oxides, electroconductive polymers, and carbon black. The metals are exemplified by aluminum, zinc, copper, chromium, nickel, stainless steel, and silver, and such metals deposited on the surface of plastic particles. The metal oxides are exemplified by zinc oxide, titanium oxide, tin oxide, antimony oxide, indium oxide, bismuth oxide, indium oxide doped with tin, tin oxide doped with antimony, and zirconium oxide. The electroconductive polymers are exemplified by polyacetylenes, polythiophenes, and polypyrroles. These materials may be used singly or combinedly. The two or more materials combinedly used may be in a state of simple mixture, a solid solution, or a fusion form.

The average particle diameter of the electroconductive particles used in the present invention is preferably not more than 0.3 $\mu$m, more preferably not more than 0.1 $\mu$m to prevent light scattering. The metal oxides are preferred to the metals in view of the transparency.

The ratio of the fluorine-containing compound to the electroconductive particles depends on the particle size, and is preferably in the range of from 1 to 50% by weight, more preferably from 3 to 40% by weight based on the electroconductive particles.

The surface-treating agent for the electroconductive particles includes silane coupling agents, silicone oils, siloxane compounds, and surfactants. In the present invention, fluorine-containing compounds are particularly effective in view of the dispersibility and dispersion stability of the electroconductive particles. The examples are enumerated below without limiting the compounds thereto.

The preferred fluorine-containing silane coupling agents are:

$$CF_3CH_2CH_2Si(OCH_3)_3,$$

$$C_4F_9CH_2CH_2Si(OCH_3)_3,$$

$$C_6F_{13}CH_2CH_2Si(OCH_3)_3,$$

$$C_8F_{17}CH_2CH_2Si(OCH_3)_3,$$

$$C_8F_{17}CH_2CH_2Si(OCH_2CH_2OCH_3)_3,$$

$$C_{10}F_{21}Si(OCH_3)_3,$$

$$C_6F_{13}CONHSi(OCH_3)_3,$$

$$C_8F_{17}CONHSi(OCH_3)_3,$$

$$C_7F_{15}CONHCH_2CH_2CH_2Si(OCH_3)_3,$$

-continued $C_7F_{15}CONHCH_2CH_2CH_2Si(OC_2H_5)_3$, $C_7F_{15}COOCH_2CH_2CH_2Si(OCH_3)_3$, $C_7F_{15}COSCH_2CH_2CH_2Si(OCH_3)_3$, $C_8F_{17}SO_2NHCH_2CH_2CH_2Si(OC_2H_5)_3$, $C_8F_{17}SO_2N(CH_2CH_2CH_3)CH_2CH_2CH_2Si(OCH_3)_3$, $C_8F_{17}CH_2CH_2SCH_2CH_2Si(OCH_3)_3$, $C_{10}F_{21}CH_2CH_2SCH_2CH_2Si(OCH_3)_3$, $C_7F_{15}CONHCH_2CH_2N(COC_7F_{15})CH_2CH_2CH_2Si(OCH_3)_3$, $C_7F_{15}SO_2NHCH_2CH_2N(SO_2C_8F_{17})CH_2CH_2CH_2Si(OCH_3)_3$, The preferred fluorine-modified silicone oils are:

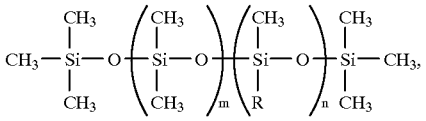

where R denotes a group of $—CH_2CH_2CF_3$, and m and n are respectively a positive integer.

The preferred fluorine type surfactants are:

$X—SO_2NRCH_2COOH$, $X—SO_2NRCH_2CH_2O(CH_2CH_2O)_nH$(n = 5, 10, 15), $X—SO_2N(CH_2CH_2CH_2OH)_2$, $X—RO(CH_2CH_2O)_n$(n = 5, 10, 15), $X—(RO)_n$(n = 5~20), $X—(RO)_n R$(n = 5~20), $X—SO_2NRCH_2CH(\backslash/O)CH_2$, $X—COOH$, $X—CH_2CH_2COOH$, $X—ORCOOH$, $X—ORCH_2COOH$, $X—SO_3H$, $X—ORSO_3H$, $X—CH_2CH_2OH$, $X—CH_2OCH_2CH(\backslash/O)CH_2$, $X—CH_2CH_2OCH_2CH(\backslash/O)CH_2$, $X—CO_2CH_2CH(\backslash/O)CH_2$, where R is a group of alkyl, aryl, or aralkyl, X is a fluorinated carbon group such as $—CF_3$, $—C_4F_9$, and $C_8F_{17}$.

Of the compounds shown above, the compounds represented by the general formula (1) below are especially effective.

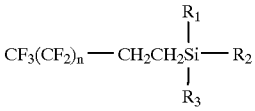

(1)

where n is an integer of zero or more, and $R_1$, $R_2$, and $R_3$ are respectively a chlorine atom, a methyl group, a methoxy group, or an ethoxy group.

The surface treatment of the electroconductive particles is conducted as follows. The electroconductive particles and the fluorine-containing compound are mixed and dispersed in a suitable solvent by means of a conventional dispersion means such as a ball mill and a sand mill. From the liquid dispersion, the solvent is removed to allow the fluorine-containing compound to adhere onto the surface of the electroconductive particles. The particles may be heat-treated, if necessary. Into the treating liquid, a catalyst may be added to promote the reaction. The treated electroconductive particles may further crashed, if necessary.

The binder resin for the surface layer in the present invention includes acrylic resins, polyester resins, polycarbonate resins, polystyrene resins, cellulose resins, polyethylene resins, polypropylene resins, polyurethane resins, epoxy resins, silicone resins, melamine resins, fluoroplastic resins, alkyd resins, vinyl chloride-vinyl acetate copolymer resins, and polyvinyl chloride resins. Of these resins, hardening resins are suitable in view of the surface hardness and abrasion-resistance of the surface layer, and the dispersibility and dispersion stability of the electroconductive particles. The surface layer having high transparency, high hardness, and high abrasion resistance can be formed in such a manner that a coating liquid is prepared by dispersing the aforementioned surface-treated electroconductive particles in a solution containing a heat- or light-curable monomer or oligomer, and the resulting liquid dispersion is applied onto a photosensitive layer and is cured.

The ratio of the resin to the surface-treated electroconductive particles is one of the main factors for the resistivity of the surface layer. The amount of the resin is preferably in the range of from 10 to 70% by weight based on the total weight of the surface layer. The resistivity of the surface layer depends not only on the charge injection but also on stability of the electrophotographic properties of the photosensitive member, and the optimum resistivity ranges preferably from $10^{14}$ to $10^{9}$ Ω.cm, more preferably from $1\times10^{13}$ to $1\times10^{10}$ Ω.cm. The thickness of the surface layer depends on the resistivity of the surface layer, and ranges preferably from 0.1 to 10 μm, more preferably from 0.5 to 5 μm.

The surface layer in the present invention may contain an additive such as a coupling agent, and an antioxidant for improvement in dispersibility, binding strength, and weatherability, and a charge-transporting substance for improvement in electrophotographic properties.

The photosensitive layer is explained below. The constitution of the photosensitive layer of the electrophotographic photosensitive member of the present invention is classified into two types: a single layer type containing both a charge-generating substance and a charge-transporting substance in one and the same layer; and a lamination type having a charge-generating layer and a charge-transporting layer. In the present invention, a lamination type of photosensitive layer is preferred, in particular, the one having a charge-transporting layer formed on a charge-generating layer is more preferred.

In the lamination type photosensitive layer, the charge-generating layer may contain either inorganic charge-generating substances or an organic charge-generating substances, the inorganic charge-generating substance including selenium, selenium-tellurium, and amorphous silicon; and the organic charge-generating substances including cationic dyes such as pyrylium dyes, thiapyrylium dyes, azulenium dyes, thiacyanine dyes, and quinocyanine dyes; squarium pigments; phthalocyanine pigments; polycyclic quinone dyes such as anthanthorone pigments, dibenzpyrenequinone pigments, and pyranthorone pigments; indigo pigments; quinacridone pigments; and azo pigments. These substances may be used singly or in combination of two or more thereof.

The charge-generating layer can be formed by vacuum vapor deposition as a vapor-deposited layer, or by applying and drying a coating liquid comprising a binder resin and the aforementioned charge-generating substance dispersed therein as a coated layer.

The binder resin for charge-generating layer formation is selected from among a variety of insulating resins, and organic photoconductive polymers such as poly-N-vinylcarbazole and a polyvinylpyrene. The preferred binder resin includes polyvinylbutyral resins, polyarylate resins (e.g., polycondensation product of bisphenol-A with phthalic acid), polycarbonate resins, polyester resins, polyvinyl acetate resins, acrylic resins, polyacrylamide resins, polyamide resins, cellulose resins, urethane resins, epoxy resins, and polyvinyl alcohol resins. The amount of the resin in the charge-generating layer is preferably not more than 80% by weight, more preferably not more than 40% by weight.

The thickness of the charge-generating layer is preferably not more than 5 $\mu$m, more preferably ranges from 0.01 to 1 $\mu$m.

The charge-transporting layer can be formed by applying and drying a coating liquid comprising a charge-transporting substance dispersed in a binder resin, the charge-transporting substance including polycyclic aromatic compounds having a structure of biphenylene, anthracene, pyrene, phenanthrene, and the like in the main chain or the branch thereof; nitrogen-containing cyclic compounds such as indole, carbazole, oxadiazole, and pyrazoline; hydrazone compounds, and styryl compounds.

The binder resin for the charge-transporting layer includes polyarylate resins, polysulfone resins, polyamide resins, acrylic resins, acrylonitrile resins, methacrylic resins, vinyl chloride resins, vinyl acetate resins, phenol resins, epoxy resins, polyester resins, alkyd resins, polycarbonate resins, and polyurethane resins; and copolymers such as styrene-butadiene copolymers, styrene-acrylonitrile copolymers, and styrene-maleic acid copolymers. The binder resin further includes organic photoconductive resin such as polyvinylcarbozole resins, polyvinylanthracene resins, and polyvinylpyrene resins in addition to the above insulating resins. The blending ratio of the charge-transporting substance to the binder resin ranges preferably from 10 to 500 parts by weight of the charge-transporting substance to 100 parts by weight of the binder resin.

The thickness of the charge-transporting layer ranges preferably from 5 to 40 $\mu$m, more preferably from 10 to 30 $\mu$m.

On the other hand, the monolayer type photosensitive layer can be formed by applying and drying a coating liquid prepared by dispersing or dissolving the aforementioned charge-generating substance, the charge-transporting substance, and the aforementioned binder resin in a solvent. The monolayer type photosensitive layer has a thickness ranging preferably from 5 to 40 $\mu$m, more preferably from 10 to 30 $\mu$m.

An interlayer may be provided between the surface layer and the photosensitive layer in the present invention to improve the adhesiveness between the surface layer and the photosensitive layer, and to obtain a function of a barrier layer to the charge. The material for the interlayer includes resins such as epoxy resins, polyester resins, polyamide resins, polystyrene resins, acrylic resins, and silicone resins.

A subbing layer, namely a layer having a barrier function and an adhesive function, may be provided between the electroconductive support and the photosensitive layer in the present invention. The material for the subbing layer includes polyvinyl alcohols, polyethylene oxides, nitrocellulose, ethylcellulose, methylcellulose, ethylene-acrylic acid copolymers, alcohol-soluble amides, polyamides, polyurethanes, casein, glue, and gelatin. The subbing layer can be formed by applying a solution of the material in a suitable solvent to an electroconductive support. The thickness of the subbing layer is preferably not more than 5 $\mu$m, preferably ranging from 0.2 to 0.3 $\mu$m.

The aforementioned layers may be applied by a coating method such as dip coating, spray coating, beam coating, spinner coating, roller coating, Meyer bar coating, and blade coating.

The electroconductive support may be made of a metal such as aluminum, aluminum alloys, copper, zinc, stainless steel, vanadium, molybdenum, chromium, titanium, nickel, indium, gold, and platinum. The support may also be a plastics (e.g., polyethylene, polypropylene, polyvinyl chloride, polyethylene terephthalate, and an acrylic resin) having a metal coat layer formed thereon by vacuum-deposition of the above metal or alloy, or may be a plastic, a metal, or a metal alloy coated with a film composed of a electroconductive particles (e.g., carbon black and silver particles) and a binder resin, or plastic or paper impregnated with electroconductive particles.

The shape of the support is selected to be most suitable for the electrophotographic apparatus to be employed, and may be in a shape of a drum, a sheet, or a belt.

The charging member of the charging means in the present invention is not specially limited, provided that it is capable of coming into contact with the surface of the electrophotographic photosensitive member and has electroconductivity for injection of electric charge directly into the electroconductive fine particles. The charging member includes charging magnetic brushes, charging rollers, charging blades, and charging fiber brushes, but is not limited thereto. Of these, the charging magnetic brushes and charging rollers are preferred in view of endurance, and the magnetic brushes are particularly preferred in view of uniform charging.

In the charging magnetic brush method, ears of particles of a magnetic material such as ferrite are formed in a high density in a shape of a brush by magnetic force, and the formed brush serves as a charger on application of voltage. The ears can be made in a considerably high density to enable finer and more uniform charging.

If the magnetic brush and the photosensitive member moves at the same peripheral speed, the nip width of the magnetic brush cannot be secured since the magnetic brush itself exhibits no restoring tendency physically when the magnetic brush is pushed aside by deflection or eccentricity of the photosensitive member, which would cause insufficient charging. Therefore, some difference in the peripheral speeds is required. Even with the peripheral speed difference, the photosensitive member will not be damaged by physical scratching of the surface by the ears since the ears of the magnetic brush are less rigid than the fiber brush, and can be brought into soft contact with the photosensitive member without causing a problem. To the contrary, the fiber brush tends to come down (or slant) in comparison with the magnetic brush during repeated use.

The charging roller and the charging blade may have a constitution in which a coat layer containing electroconductive particles dispersed therein is provided as a resistance layer on a roller-shaped or blade-shaped elastic layer. The resistance of the resistance layer ranges preferably from $1\times10^4$ to $1\times10^7\Omega$. With the resistance of lower than $1\times10^4\Omega$, pinhole leakage is liable to occur, while with the resistance of higher than $1\times10^7\Omega$, the current for charging tends to be insufficient.

The elastic layer of the charging member is formed from a resin material including thermosetting elastomers such as synthetic elastomers, e.g., EPDM, EPT, EPM, NBR, BR, BR, and CR, and thermoplastic elastomers, e.g., polyvinyl chloride resins, polyvinyl acetate resins, polyester resins, and PVA resins. The electroconductive particles for imparting electroconductivity to the elastic layer includes particles of carbon black, zinc oxide, titanium oxide, and powdery metal. The elastic layer has preferably a hardness of from 20 to 80° according to JIS K 6301 with A-type hardness tester.

The resin material for the resistance layer provided on the surface of the charging member includes materials which is flexible at ordinary temperature, exemplified by polyamide resins, polyimide resins, fluoroplastic resins, silicone resins, PVA resins, and polyester resins.

The elastic layer has a thickness of preferably from 1 to 3 mm.

The resistance layer has a thickness of preferably from 1 to 500 $\mu$m.

The voltage applied to the charging member is preferably 1 to 1.5 times the intended surface potential of the photosensitive member in terms of the DC component. The applied voltage may be a pulse voltage having an AC component in order to attain more uniform charging. The AC component is preferably not larger than twice, more preferably not larger than 1.5 times the intended charging potential.

FIG. 1 illustrates schematically a construction of an electrophotographic apparatus of the present invention. In FIG. 1, the numeral 1 indicates an electrophotographic photosensitive member; 2 a charging magnetic brush; 2*a* a magnetic sleeve; L a scanning exposure light (laser beam); 3 a developing means; 3*a* a developing sleeve; 4 contacting transfer means (transfer roller); 5 a fixing means; 6 a cleaning means; P a transfer-receiving medium; 7 a frame of a process cartridge; and $S_1$, to $S_3$ a high voltage power source respectively.

In the present invention, the electrophotographic photosensitive member, the charging means, and the development means and the cleaning means are integrated in one unit as a process cartridge and the process cartridge may be detachably mounted on the main body of the electrophotographic apparatus.

Figure 2:
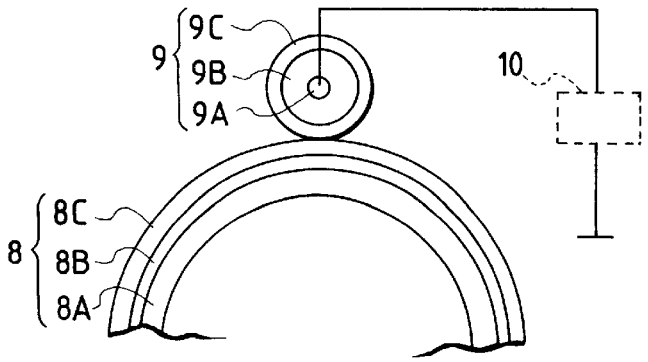
FIG. 2 illustrates schematically another specific example of the electrophotographic apparatus of the present invention.

FIG. 2 illustrates schematically a specific example of another electrophotographic apparatus of the present invention. In FIG. 2, the numeral 8 indicates an electrophotographic photosensitive member; 8A an electroconductive support; 8B a photosensitive layer; 8C a surface layer; 9 a charging member; 9A a core metal portion; 9B an elastic layer; 9C a resistance layer; and 10 a power source.

The photosensitive member of the present invention is useful not only for electrophotographic copying machines but is useful in variety of electrophotography application fields such as laser beam printers, CRT printers, LED printers, liquid crystal printers, and laser engraving.

The present invention is described below in more detail by reference to examples and comparative examples. The term "part" hereinafter is based on weight.

EXAMPLE 1

A coating solution for subbing layer formation was prepared by dissolving 10 parts of a alcohol-soluble polyamide resin (Amilan CM-8000, produced by Toray Industries, Inc.) and 30 parts of methoxymethylated 6-nylon resin (Toresin EF-30T, produced by Teikoku Kagaku K.K.) in a mixed solvent of 150 parts of methanol and 150 parts of butanol. On an aluminum cylinder (30 mm in diameter and 260 mm in length), the above solution was applied by dip coating, and the coated matter was dried at 90° C. for 10 minutes to form a subbing layer of 1 $\mu$m thick.

Separately, a liquid dispersion for charge-generating layer formation was prepared by dispersing 4 parts of a disazo pigment represented by the formula below:

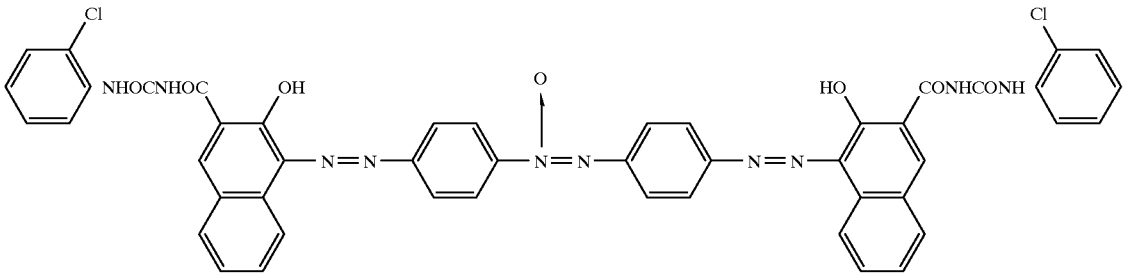

2 parts of a butyral resin (S-LEC BL-S, produced by Sekisui Chemical Co., Ltd.) in 100 parts of cyclohexanone by means of a sand mill for 48 hours, and adding thereto 100 parts of tetrahydrofuran (THF). This liquid dispersion was applied on the above subbing layer by dip coating, and dried at 80° C. for 15 minutes to form a charge-generating layer of 0.15 μm thick.

A soforman for a charge-transporting layer formation was prepared by dissolving 10 parts of a hydrazone compound represented by the formula below:

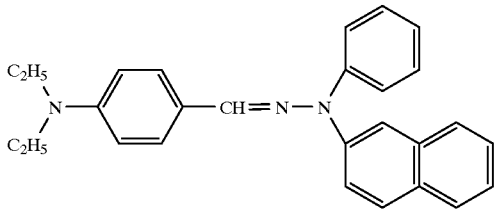

and 10 parts of a polycarbonate resin (IUPILON Z-200, produced by Mitsubishi Gas Chemical Co., Inc.) in a mixed solvent composed of 20 parts of dichloromethane and 60 parts of monochlorobenzene. This solution was applied onto the above charge-generating layer by dip coating, and dried at 120° C. for 60 minutes to form a charge-transporting layer of 18 μm thick.

Fine particulate material for the surface layer was prepared as below. 100 Parts of fine particulate antimony-containing tin oxide of 0.02 μm in average diameter (T-1, produced by Mitsubishi Materials Corporation), 10 parts of (3,3,3-trifluoropropyl) trimethoxysilane (produced by Chisso Corporation), and 300 parts of ethanol were stirred with a stirring apparatus for 48 hours. Then the particulate matter was collected by filtration, washed, and dried. The dried particulate matter was further heat-treated at 150° C. for 2 hours to complete the surface treatment of the electroconductive particles.

A coating liquid for surface layer formation was prepared by mixing 50 parts of an acrylic monomer represented by the formula below:

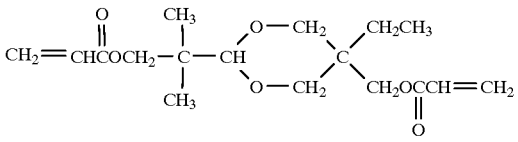

2 parts of 2-methylthioxanthone as a photopolymerization initiator, 40 parts of the above surface-treated fine particulate material, and 300 parts of ethanol were mixed, and dispersed by means of a sand mill for 96 hours.

This coating liquid was applied on the aforementioned charge-transporting layer by dip coating, dried and exposed to UV light irradiation with a metal halide lamp at a light intensity of 250 mW/cm$^2$ for 60 seconds to form a surface layer of 3 μm thick. Thus a photosensitive member was prepared.

FIG. 1 illustrates schematically a construction of a laser beam printer which is an electrophotographic apparatus of the present invention, which conducts the processes of charging, light exposure, image development, image transfer, and cleaning of the photosensitive member, in which charging is conducted by a charging magnetic brush system. The charging magnetic brush employed herein is explained below.

The charging magnetic brush is constituted from a non-magnetic electroconductive sleeve, a magnetic roll provided therein, and magnetic electroconductive particles on the sleeve. The magnet roll is fixed, and the sleeve surface moves rotationally in the direction reverse to the peripheral movement of the photosensitive drum.

The resistance value of the magnetic brush is defined as the value measured by bringing an aluminum drum into contact with the above magnetic brush and applying DC voltage of 100 V.

The magnetic electroconductive particulate matter includes particles formed from a blend of a resin and a powdery magnetic matter such as magnetite, or the blend further containing electroconductive carbon for resistivity control; particles formed from sintered magnetite or ferrite, or those reduced for resistivity control; and above magnetic particles further treated for metal-plating to control the resistivity.

In the Examples of the present invention, the magnetic particulate matter was prepared by blending 100 parts of magnetite with a polystyrene resin and pulverizing the blend to have a particle diameter of 30 μm and a resistance of $1\times10^6$ Ω. This resistance is approximately equal to the resistivity of the magnetite itself. The resistance can be increased by decreasing the blending amount of the magnetite, and can be decreased by adding carbon black to the surface of the particles to obtain a desired resistivity.

Such electroconductive particles are laid on the sleeve in a thickness of 1 mm to form a charging nip of about 2 mm from the photosensitive member. The sleeve rotates at the same peripheral speed as the surface of the photosensitive member in the reversed direction slidably, thereby the magnetic brush is brought into contact with the photosensitive member.

The method of evaluation and the results are described below.

The photosensitive member prepared above was mounted on a laser beam printer having a construction as shown in FIG. 1. The process speed was 100 mm/sec. This printer was used for image evaluation at the normal temperature and normal humidity (N/N) of 20° C. and 50%; at a low temperature and low humidity (L/L) of 10° C. and 15%; and at a high temperature and high humidity (H/H) of 35° C. and 85%. The formed image was evaluated and was found to be satisfactory without white spot or fogging in comparison with later shown Comparison Example where the photosensitive member had a surface layer containing non-surface-treated electroconductive particles. Further, a running test of image formation was conducted to form 100,000 sheets of images at the normal temperature and normal humidity. As the results, excellent images were formed invariably throughout the 100,000-sheet running test. The results are shown in Table 1.

EXAMPLE 2

A photosensitive member was prepared and evaluated in the same manner as in Example 1 except that the coating liquid for the surface layer was changed to the one prepared as below.

100 Parts of fine particulate antimony-containing tin oxide of 0.02 pm in average diameter (T-1, produced by Mitsubishi Materials Corporation), 5 parts of (6,6,6,5,5,4,4,3,3-nonafluorohexyl)-trimethoxysilane (produced by Shin-Etsu Chemical Co., Ltd.), and 300 parts of butanol were stirred with a stirring apparatus for 48 hours. Then the particulate matter was collected by filtration, washed, and dried. The dried particulate matter was further heat-treated at 180° C. for 2 hours to complete the surface treatment of the electroconductive fine particulate matter.

Then, the coating liquid for the surface layer was prepared by mixing 20 parts of an acrylic monomer represented by the formula below:

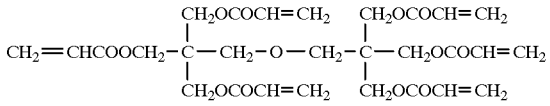

20 parts of a bisphenol Z type polycarbonate resin (weight-average molecular weight of 20,000), 20 parts of 2-methylthioxanthone as a photopolymerization initiator, 40 parts of the above surface-treated electroconductive fine particles, and 300 parts of ethanol were mixed, and dispersed by means of a sand mill for 96 hours.

EXAMPLE 3

A photosensitive member was prepared and evaluated in the same manner as in Example 1 except that the coating liquid for the surface layer was changed to the one prepared as below.

100 Parts of fine particulate tin-containing indium oxide of 0.02 μm in average diameter (ITO, produced by Mitsubishi Materials Corporation), 30 parts of (10,10,10,9,9,8,8,7,7,6,6,5,5,4,4,3,3-heptadecafluorodacanyl) trimethoxysilane (produced by Shin-Etsu Chemical Co., Ltd.), and 300 parts of toluene were stirred with a stirring apparatus for 60 hours. Then the particulate matter was collected by filtration, washed, and dried. The dried particulate matter was further heat-treated at 150° C. for 3 hours to complete the surface treatment of the electroconductive fine particulate matter.

Then, the coating liquid for the surface layer was prepared by dispersing 45 parts of methyltrimethoxysilane in 300 parts of toluene by means of a sand mill for 96 hours.

This coating liquid was applied by spray coating, and heated at 160° C. for one hour to form a surface layer of 3 μm thick.

Comparative Example 1

A photosensitive member was prepared and evaluated in the same manner as in Example 1 except that the electroconductive particles for the surface layer was not surface-treated.

As the results, fine spots and image fogging were observed in the initially formed image as shown in Table 1. Therefore, the running tests was not conducted.

Comparative Example 2

A photosensitive member was prepared and evaluated in the same manner as in Example 1 except that a fiber brush was employed as the charging means of the laser beam printer.

As the results, in the initially formed image, neither fine spots nor image fogging was observed as shown in Table 1.

TABLE 1

| | Image Evaluation | | | |
|---|---|---|---|---|
| | N/N | | L/L | H/H |
| | Initial stage | End of running test | Initial stage | Initial stage |
| Example 1 | Good | Good | Good | Good |
| Example 2 | Good | Good | Good | Good |
| Example 3 | Good | Good | Good | Good |
| Comparative Example 1 | A few spots formed | Not conducted | A few spots formed | Many spots formed |
| Comparative Example 2 | Good | Poor | Good | Good |

EXAMPLE 4

A coating solution for subbing layer formation was prepared by dissolving 10 parts of a alcohol-soluble polyamide resin (Amilan CM-8000, produced by Toray Industries, Inc.) and 30 parts of a methoxymethylated nylon resin (Toresin EF-30T, produced by Teikoku Kagaku K.K.) in a mixed solvent of 150 parts of methanol and 150 parts of butanol. On an aluminum support, the above solution was applied by dip coating, and the coated matter was dried at 90° C. for 10 minutes to form a subbing layer of 1 μm thick.

Separately, a liquid dispersion for charge-generating layer was prepared by dispersing 4 parts of a disazo pigment represented by the formula below:

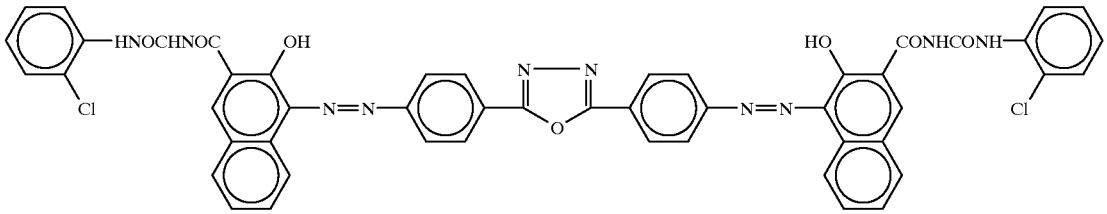

2 parts of a butyral resin (S-LEC BL-S, produced by Sekisui Chemical Co., Ltd.) in 100 parts of cyclohexanone by means of a sand mill for 48 hours, and adding thereto 100 parts of tetrahydrofuran (THF).

This liquid dispersion was applied on the above subbing layer by dip coating, and dried at 80° C. for 15 minutes to form a charge-generating layer of 0.15 μm thick.

A solution for a charge-transporting layer formation was prepared by dissolving 10 parts of a triarylamine compound represented by the formula below:

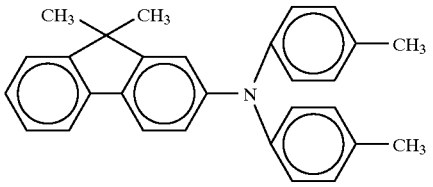

and 10 parts of a polycarbonate resin (IUPILON Z-200, produced by Mitsubishi Gas Chemical Co. Inc.) in a mixed solvent composed of 20 parts of dichloromethane and 50 parts of monochlorobenzene. This solution was applied onto the above charge-generating layer by dip coating, and dried at 120° C. for 60 minutes to form a charge-transporting layer of 20 μm thick.

Fine particulate material for the surface layer was prepared as below. 100 Parts of fine particulate antimony-containing tin oxide of 0.02 μm in average diameter (T-1, produced by Mitsubishi Materials Corporation), 30 parts of (3,3,3-trifluoropropyl)-trimethoxysilane (produced by Shin-Etsu Chemical Co., Ltd.), and 300 parts of 95% ethanol (containing 5% water) were subjected to milling treatment with a milling apparatus for one hour. Then the particulate matter was collected by filtration, washed with ethanol, and dried. The dried particulate matter was further heat-treated at 120° C. for one hour to complete the surface treatment.

A coating liquid dispersion for surface layer formation was prepared by dispersing 25 parts of an acrylic monomer represented by the formula below:

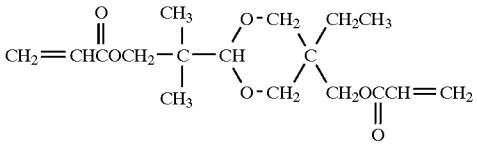

2 parts of 2-methylthioxanthone as a photopolymerization initiator, and 35 parts of the above surface-treated fine particulate antimony-containing tin oxide were dispersed in 300 parts of ethanol by means of a sand mill for 96 hours.

This liquid dispersion was applied on the aforementioned charge-transporting layer by dip coating, dried and exposed to UV light irradiation with a high pressure mercury lamp at a light intensity of 800 mW/cm$^2$ for 15 seconds to form a surface layer of 5 μm thick. In the liquid dispersion for surface layer formation, the fine particles were well dispersed, and the face of the surface layer was uniform.

The contact charging member was prepared as below.

A starting material compound was prepared for the elastic layer of the contact charging member by mixing 100 parts of an EPDM compound, 5 parts of KETJEN BLACK, and 10 parts of paraffin oil for 30 minutes by means of a twin roll cooled at 20° C. To 100 parts of the resulting mixture, 2 parts of dicumyl peroxide was added, and mixture was further blended with the roll for two hours. With this compound, an elastic layer was formed and vulcanized in a thickness of 12 mm around the core metal of stainless steel of 6 mm in outside diameter.

A coating paint for the resistance layer was prepared by dissolving 100 parts of methylol nylon, 10 parts of KETJEN BLACK, and 200 μpm of silicone oil (molecular weight 2000) in methanol-toluene mixed solvent. This coating liquid was applied on the above elastic layer by dip coating to form a resistance layer of 20 μm thick. Thus a roller-shaped contact charging member was prepared.

The above photosensitive member and the charging roller were fixed in the prescribed positions in a cartridge for LBP-8II (manufactured by Canon K.K.). The core metal charged by application of bias of a DC voltage (VDC) of −700 V and an AC voltage ($V_{p-p}$) of 1200 V, 900 Hz, application of pressure of 300 g at the both ends of the core metal portion to stabilize the contact.

The image formed was evaluated for the evaluation items under the evaluation standards below.

(1) No fogging of image (fogging caused by insufficient charging):

Fogging was observed by outputting blank printing (solid white). The evaluation standards are as below:

E: excellent, no discernible fogging
G: good, no significant fogging
F: fair, local fogging, but useful practically
P: poor, fogging entirely, lowest image quality for practical use
U: unacceptable, fogging entirely (2) Half tone reproducibility:

A line image was formed with fine lines of 100 μm wide at intervals of 100 μm in a main scanning direction. This line image was observed by a microscope at a magnification of 20×. The developed image was evaluated for evenness of the fine lines (absence of irregularity), and the reproducibility (absence of displacement relative to the latent image) thereof. The evaluation standards are as below:

E: excellent, irregularity of 20 μm or less displacement of ±10 μm or less
F: fair, irregularity of 50 μm or less displacement of ±30 μm or less (practically useful)
U: unacceptable, irregularity of 80 μm or less displacement of ±50 μm or less (practically not useful)

The formed images are evaluated for the above items at the time of the start of the paper feed (initial stage), and after image formation of 30,000 sheets (running test).

As the results, the formed images were satisfactory in the image quality and in the chargeableness, and in half tone reproducibility both in the initial stage and after the 30,000-sheet running test. The results are shown in Table 2.

Comparative Example 3

A photosensitive member was prepared in the same manner as in Example 4 except that the surface layer was not provided on the photosensitive layer. The photosensitive member was evaluated in the same manner as in Example 4. Fogging of the image was observed to occur owing to insufficient charging. The surface potential was found insufficient to be as low as −500 V. The reproducibility of the half tone was satisfactory. The results are shown in Table 2.

Comparative Example 4

A photosensitive member was prepared in the same manner as in Example 4 except that the surface treatment of the electroconductive fine particles was not conducted. The photosensitive member was evaluated in the same manner as in Example 4. The images in the initial stage had good quality. However, after the running test, fogging of the images owing to insufficient charging, and irregularity of the image density owing to the insufficient dispersion of the electroconductive particles were observed. The results are shown in Table 2.

EXAMPLE 5

A photosensitive member was prepared and evaluated in the same manner as in Example 4 except that the surface layer was formed as described below.

Fine particulate material for the surface layer was treated as below. 100 Parts of fine particulate antimony-containing tin oxide of 0.02 μm in average diameter (T-1, produced by Mitsubishi Materials Corporation), 30 parts of fluorine-modified silicone oil (FL-100, produced by Shin-Etsu Chemical Co., Ltd.), and 300 parts of toluene were subjected to milling treatment with a milling apparatus for one hour. Then the particulate matter was collected by filtration, washed with toluene, and dried. The dried particulate matter was further heat-treated at 300° C. for 10 minutes to complete the surface treatment of the electroconductive fine particles.

A coating liquid dispersion for surface layer formation was prepared by dispersing 25 parts of an acrylic monomer represented by the formula below:

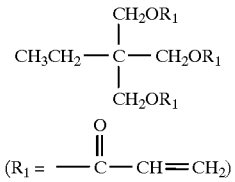

2 parts of 2-methylthioxanthone as a photo-polymerization initiator, and 50 parts of the above surface-treated fine particulate antimony-containing tin oxide in 300 parts of toluene by means of a sand mill for 96 hours.

This liquid dispersion was applied on the same charge-transporting layer as that of Example 4 by spray coating, dried, and exposed to UV light irradiation with a high pressure mercury lamp at a light intensity of 800 mW/cm$^2$ for 15 seconds to form a surface layer of 5 μm thick.

The absence of fogging and the reproducibility of the half tone were satisfactory both in the initial stage and after the running test. The results are shown in Table 2.

EXAMPLE 6

A photosensitive member was prepared and evaluated in the same manner as in Example 4 except that the surface layer was formed as described below.

Fine particulate material for the surface layer was treated as below. 100 Parts of fine particulate antimony-containing tin oxide of 0.02 μm in average diameter (T-1, produced by Mitsubishi Materials Corporation), 30 parts of (3,3,3-trifluoropropyl)-trimethoxysilane (produced by Shin-Etsu Chemical Co., Ltd.), and 300 parts of 95% ethanol (containing 5% water) were subjected to milling treatment with a milling apparatus for one hour. Then the particulate matter was collected by filtration, washed with ethanol, and dried. The dried particulate matter was further heat-treated at 120° C. for one hour to complete the surface treatment of the electroconductive fine particles.

A coating liquid dispersion for surface layer formation was prepared by dispersing 30 parts of a polycarbonate resin (IUPILON Z-200, produced by Mitsubishi Gas Chemical Co., Inc.) as the binder, 50 parts of the above surface-treated fine particulate antimony-containing tin oxide in 400 parts of toluene by means of a sand mill for 48 hours.

This liquid dispersion was applied on the same charge-transporting layer as that of Example 4 by spray coating, and was dried at 120° C. for 60 minutes to form a surface layer of 6 μm thick.

The photosensitive member with this surface layer did not cause discernible fogging and exhibited good half-tone reproducibility at the initial stage. However, at the end of the running test, occurrence of local fogging and local lowering of the half tone reproducibility were observed. The results are shown in Table 2.

EXAMPLE 7

A photosensitive member was prepared and evaluated in the same manner as in Example 4 except that only DC voltage, $V_{DC}$=−700 V, was applied to the charging member in the evaluation without application of AC voltage. As the results, fogging did not occur, and half tone reproducibility was satisfactory both at the initial stage and at the end of the running test. The results are shown in Table 2.

TABLE 2

| | Initial Stage | | End of Running Test | |
|---|---|---|---|---|
| | No image fogging | Half tone reproduc-ibility | No image fogging | Half tone reproduc-ibility |
| Example 4 | E | E | E | E |
| Example 5 | E | E | E | E |
| Example 6 | E | E | F | F |
| Example 7 | E | E | E | E |
| Comparative Example 3 | U | E | U | E |
| Comparative Example 4 | E | E | U | U |

What is claimed is:

1. An electrophotographic apparatus comprising: an electrophotographic photosensitive member having a photosensitive layer on an electroconductive support, a charging means provided in contact with the photosensitive member, an image exposure means, a development means, and an image transfer means; the electrophotographic photosensitive member having a surface layer containing electroconductive particles having particles surface treated with a fluorine-containing compound selected from the group consisting of fluorine-containing silane coupling agents, fluorine-containing silicone oils, fluorine-containing siloxane compounds and fluorine-containing surfactants, and a binder resin.

2. An electrophotographic apparatus according to claim 1, wherein the charging member is a charging magnetic brush or a charging roller.

3. An electrophotographic apparatus according to claim 2, wherein the charging member is a charging magnetic brush. selected from silane coupling agents, silicone oils, siloxane compounds, and surfactants.

4. An electrophotographic apparatus according to claim 1, wherein the fluorine-containing compound is the one represented by the formula (1):

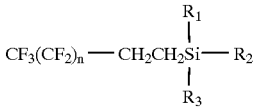

(1)

where n is an integer of zero or more, and $R_1$, $R_2$, and $R_3$ are respectively a chlorine atom, a methyl group, a methoxy group, or an ethoxy group.

5. An electrophotographic apparatus according to claim 1, wherein the binder resin is a hardening resin.

6. A process cartridge comprising: an electrophotographic photosensitive member having a photosensitive layer on an electroconductive support, a charging means provided in contact with the photosensitive member, and at least a development means or a cleaning means; the electrophotographic photosensitive member having a surface layer containing electroconductive particles having particles surface treated with a fluorine-containing compound selected from the group consisting of fluorine-containing silane coupling agents, fluorine-containing silicone oils, fluorine-containing siloxane compounds and fluorine-containing surfactants, and a binder resin; the electrophotographic photosensitive member, the charging means, and the at least the development means or the cleaning means being integrated in one unit and the process cartridge being detachably mounted on a main body of the electrophotographic apparatus.

7. A process cartridge according to claim 6, wherein the charging member is a charging magnetic brush or a charging roller.

8. A process cartridge according to claim 7, wherein the charging member is a charging magnetic brush.

9. A process cartridge according to claim 6, wherein the fluorine-containing compound is the one represented by the formula (1):

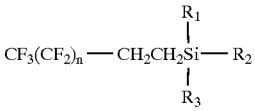

(1)

where n is an integer of zero or more, and $R_1$, $R_2$, and $R_3$ are respectively a chlorine atom, a methyl group, a methoxy group, or an ethoxy group.

10. A process cartridge according to claim 6, wherein the binder resin is a hardening resin.

* * * * *

UNITED STATES PATENT AND TRADEMARK OFFICE

CERTIFICATE OF CORRECTION

PATENT NO. : 5,923,925

DATED : July 13, 1999

INVENTOR(S) : KAZUSHIGE NAKAMURA ET AL.

It is certified that error appears in the above-identified patent and that said Letters Patent is hereby corrected as shown below:

ON THE TITLE PAGE

[57] IN THE ABSTRACT:

Line 4, "and" should read --an--.

COLUMN 2

Line 8, "(VAC)" should read --($V_{AC}$)--; and
Line 9, "(VDC)" should read --($V_{DC}$)--.

COLUMN 3

Line 50, "results" should read --result--.

COLUMN 6

Line 21, "may further crashed" should read --may be further crushed--.

COLUMN 7

Line 2, "substances," should read --substance,--; and "substance" should read --substances--;
Line 7, "anthanthorone" should read --anthanthrone--; and
Line 8, "pyranthorone" should read --pyranthrone--.

UNITED STATES PATENT AND TRADEMARK OFFICE

CERTIFICATE OF CORRECTION

PATENT NO. : 5,923,925

DATED : July 13, 1999

INVENTOR(S) : KAZUSHIGE NAKAMURA ET AL.

It is certified that error appears in the above-identified patent and that said Letters Patent is hereby corrected as shown below:

COLUMN 8

Line 40, "of a" should read --of--.

COLUMN 9

Line 2, "moves" should read --move--;
Line 29, "BR," should be deleted; and
Line 37, "is" should read --are--.

COLUMN 10

Line 35, "a" should read --an--.

COLUMN 11

Line 3, "soforman" should read --solution--; and
Line 25, "Parts" should read --parts--.

COLUMN 12

Line 13, "above" should read --the above--;
Line 58, "Parts" should read --parts--; and
Line 59, "0.02 pm" should read --0.02$\mu$m--.

UNITED STATES PATENT AND TRADEMARK OFFICE

CERTIFICATE OF CORRECTION

PATENT NO. : 5,923,925

DATED : July 13, 1999

INVENTOR(S) : KAZUSHIGE NAKAMURA ET AL.

It is certified that error appears in the above-identified patent and that said Letters Patent is hereby corrected as shown below:

COLUMN 13

Line 22, "Parts" should read --parts--;
Line 25, "heptadecafluorodacanyl" should read --heptadecafluorodecanyl--; and
Line 59, "tests" should read --test--.

COLUMN 14

Line 30, "a" should read --an--;
Line 60, close up right margin; and
Line 61, close up left margin.

COLUMN 15

Line 18, "Parts" should read --parts--;
Line 56, "mixture" should read --the mixture--; and
Line 63, "200 $\mu$pm" should read --200ppm--.

COLUMN 16

Line 4, "(VDC)" should read --($V_{DC}$)--.

COLUMN 17

Line 6, "Parts" should read --parts--; and
Line 46, "Parts" should read --parts--.

UNITED STATES PATENT AND TRADEMARK OFFICE

CERTIFICATE OF CORRECTION

PATENT NO. : 5,923,925

DATED : July 13, 1999

INVENTOR(S) : KAZUSHIGE NAKAMURA ET AL.

It is certified that error appears in the above-identified patent and that said Letters Patent is hereby corrected as shown below:

COLUMN 18

Lines 50-51, Lines 50 and 51 should be deleted.

Signed and Sealed this

Second Day of May, 2000

*Attest:*

*Attesting Officer*

Q. TODD DICKINSON

*Director of Patents and Trademarks*